US007223051B1

(12) United States Patent
Vought et al.

(10) Patent No.: US 7,223,051 B1
(45) Date of Patent: May 29, 2007

(54) REMOVABLE MAINTENANCE PORT WITH METHOD FOR REHABILITATING MANHOLE

(75) Inventors: Mack M. Vought, Little Rock, AR (US); Pat Flowers, Little Rock, AR (US)

(73) Assignee: Removable Maintenance Port, LLC, Little Rock, AR (US)

( * ) Notice: Subject to any disclaimer, the term of this patent is extended or adjusted under 35 U.S.C. 154(b) by 389 days.

(21) Appl. No.: 09/929,291

(22) Filed: Aug. 13, 2001

Related U.S. Application Data

(60) Provisional application No. 60/225,579, filed on Aug. 16, 2000.

(51) Int. Cl.
*F16L 55/18* (2006.01)

(52) U.S. Cl. ..... 405/184.1; 405/154.1

(58) Field of Classification Search ..... 405/184.1, 405/41, 40, 52–55, 154.1; 137/370, 369; 52/19, 20, 21; 404/2–5
See application file for complete search history.

(56) References Cited

U.S. PATENT DOCUMENTS 616,542 A * 12/1898 Koehne ..... 137/370
1,004,436 A * 9/1911 Kehr, Sr. ..... 137/370
1,101,908 A * 6/1914 Dennison ..... 137/370
4,089,139 A * 5/1978 Moffa et al. ..... 52/20
4,275,757 A * 6/1981 Singer ..... 52/20
4,325,405 A * 4/1982 Christo ..... 52/20
4,691,733 A * 9/1987 Zinn ..... 52/20
4,905,725 A * 3/1990 Sinkinson et al. ..... 137/370
5,265,981 A * 11/1993 McNeil ..... 405/155
5,386,669 A * 2/1995 Almeida ..... 52/19
5,634,488 A * 6/1997 Martin, Jr. ..... 137/370
5,671,772 A * 9/1997 Bliss ..... 137/370
5,901,506 A * 5/1999 Zicaro et al. ..... 52/20

* cited by examiner

*Primary Examiner*—Frederick L. Lagman
(74) *Attorney, Agent, or Firm*—Kelly Law Firm, PLC; A. J. Kelly

(57) ABSTRACT

A removably insertable apparatus for creating and accessing manholes and a method for rehabilitating manhole structures and the like, using the apparatus. The apparatus comprises two sections, both of which are load bearing composite materials such as reinforced fiberglass. The top unit is a removable, hollow, upwardly extending riser portion, of varying heights, which may contain an external flange on top, to support a manhole cover or other closure. The second section is a base unit with an outer diameter that is smaller than the inner diameter of the top unit. The base unit is embedded into the ground, or into a concrete pad. The top unit fits over the base unit, and any gap between the two units may be sealed with an o-ring type gasket to seal the interior and prevent the introduction of fluid, gas, or other matter into the interior of the units once installed. Both units may be cut on site or pre-cut with holes or stubouts. The method comprises the steps for rehabilitating an existing manhole using the apparatus.

23 Claims, 8 Drawing Sheets

REMOVABLE MAINTENANCE PORT WITH METHOD FOR REHABILITATING MANHOLE

This application claims priority from provisional application 60/225,579 filed Aug. 16, 2000.

FEDERALLY SPONSORED RESEARCH

Not Applicable.

SEQUENCE LISTING OR PROGRAM

Not Applicable.

BACKGROUND

1. Field of Invention

This invention relates to the field of apparatus and methods for access to, and repair of, underground sewer, water, and other underground pipes; and is more specifically directed to an improved mechanism to provide access to, and to rehabilitate pre-existing access to, such underground pipes, such as an existing manhole.

2. Discussion of Prior Art

Sanitary sewer systems generally include a series of manholes that are connected by sewer pipes to move waste water from sources to a sanitary treatment site. These manholes are most often constructed of concrete or block material and are conventionally shaped of cone, corbel, and bench sections. Typically, the manholes are placed more than a thousand feet apart and are connected by sewer pipes. Conventional manholes are four to five feet in diameter, and each is large enough to admit a maintenance worker into its interior, by design.

The problem with conventional manholes is that they catch water that flows into the manhole from ground level. The water can also flow in from many places, including cracks in the cone and corbel. The cracks are caused by shifts in the surrounding ground, temperature changes that affect the cement, wear from vehicle traffic, and so forth. The blocks or cement of the manholes is also susceptible to disintegration from acids created in sewer systems. Repair is required on a regular basis, and is generally an expensive proposition.

There have been attempts to replace conventional manholes. Reinforced, preformed, plastic casings have been used to replace the concrete manholes. The plastic casings purportedly cost less and eliminate some of the problems found in the concrete manholes. For example, they are less affected by temperature changes, they generally do not crack, and they are impervious to acids in the sewer system. However, current systems have their own problems. For example, the size of some casings makes them expensive to ship, and each casing may not match the requirements of the site terrain where it is to be installed. Additionally, the casings have to be sealed at the bottom to prevent leaks. Moreover, the access can be inconvenient. Maintenance is generally destructive, or at least as expensive as in conventional manholes.

Other attempted replacements have been suggested to overcome problems associated with installing a one-piece, plastic manhole casing. The other suggested casings are segmented in various ways to be assembled and installed at the site. While these casings are less expensive to ship, they are labor intensive at the installation site. They have a single input and output that are of standard size for sewer pipe in line at the sites.

The segmented and slotted casings are prone to leak and may float if installed in an area with a high water table. Most of these preformed casings are constructed of a cone, corbel, and bench in the manner of a concrete manhole. If the casing leaks, water may destroy the complete installation. Unless the casing is securely placed on a concrete foundation and surrounded by a fill material, a high water table can cause it to float and break the connections to input and output sewer pipes.

Consequently, it is not always economical to install a manhole of concrete or preformed plastic into which a maintenance worker can enter. Rather, a less expensive, more easily maintained underground pipe access can be installed to access the underground pipes, which does not necessarily accommodate a human being, but which can accommodate certain maintenance equipment.

Moreover, this apparatus can be removed, so that the conventional manhole remains, thereby permitting access to human maintenance workers. Unlike previous attempts, the removal is non-destructive.

The Port can be made of preformed plastic, polyethylene, fiberglass reinforced resin, or a similar material. It is formed in a shape to be placed below ground inside of a manhole or similar access to underground pipes. It is impervious to acids in the sewer system, and it need not be large enough for a person to enter into its body cavity for maintenance. However, it is large enough to admit equipment into its inner body for maintaining the connecting pipes, that is, equipment to clean out the pipes or admit remote video cameras to inspect the pipes. It is watertight and may have waste water connections that receive water into its inner body from several sources and access the waste water to the sanitary sewer system through an output pipe, just as conventional manholes do. The port is placed below ground and held in position by its own base, which is fixed in the ground. It is not a manhole per se. Rather, it replaces and rehabilitates a manhole by providing an impermeable chamber that is smaller than a conventional manhole, yet the top of which can be removed to access the manhole by maintenance workers in the conventional fashion.

Previous inventions have tried to provide underground pipe access of pre-formed bodies that are smaller than a conventional manhole used in sewer systems, but that can only be removed by destroying them. These purported to be water tight, and available for placement below ground with access to an inner body at ground level. These previous inventions provided only limited non-destructive entry to the inner chamber of the manhole from ground level for maintenance.

The invention resolves a number of problems that previous inventions have not yet addressed.

OBJECTS AND ADVANTAGES

The object of the invention is to provide access to existing manhole structures and the like, for creating and accessing manhole structures and the like, and providing a method for rehabilitating existing manhole structures and the like, using the apparatus described. The invention is suited for accessing vertical, generally tubular structures which can benefit from insertion of a liquid and gas impermeable chamber which prevents leakage of liquid or gas through the manhole structure into the environment, and which further benefit from more convenient access and non-destructive maintenance and repairs. The invention also eliminates gluing, bonding, or coating of manhole structures, their constituents, and the like. The invention may be used in areas of heavy traffic, as are conventional manholes, in places like city streets and thoroughfares.

The composite material used minimizes the weight of the unit, allowing installation with a minimum of manpower and machine power. The composite material can be cut in the field easily, and so can accommodate pipes of varying diameters, heights, and relative angles.

The variations of the apparatus permit prefabrication with stubout holes, or, alternatively, with pre-installed, commercially available T-type inserts, and with commercially available boot-type means for sealing. These variations will substantially minimize the construction and labor costs involved.

The Removable Maintenance Port also provides easy access to the interior of a manhole like system. The apparatus makes it easier to insert maintenance equipment, and to perform tying, hydro cleaning, and hand-rodding, all of which can be done without removing the top unit.

The top unit of the apparatus is also removable, which dramatically improves access to the manhole type systems to allow for line rehabilitation, i.e., in the manner of a conventional manhole. After rehabilitation, the top unit may be returned to its position and re-sealed with a standard cover. This aspect is not provided by any of the prior art, and permits human inspection and maintenance in a manner that neither destroys the existing manhole, nor destroys the apparatus.

The base unit is fixed in the ground, usually by cementing it in place. Because the base unit is predominantly below the underground pipes, and the underground piping flows through the base unit, the base unit remains in place during all maintenance and inspection. The base unit is an improvement over the prior art because it is a fixed base which supports the removable top unit, permitting non-destructive maintenance and inspection.

The apparatus can be used to access any underground facility, utility access, vault, cave, mine, tunnel, compartment, or similar structure.

The apparatus may also be installed as a new "manhole" or underground utility access device itself.

The apparatus and the method of using it preserves existing manhole structures for future use, even when the manhole structure develops leaking pipes, is no longer water-tight, or develops other similar problems.

Further objects and advantages of this invention will become apparent from a consideration of the drawings and ensuing description.

Figure 1:
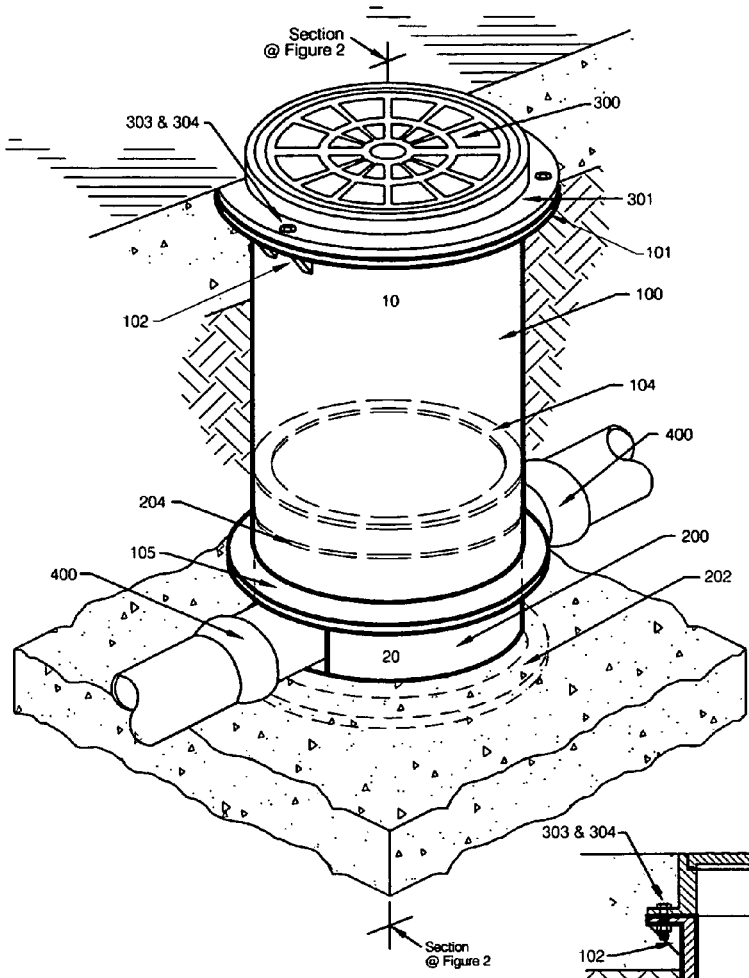
FIG. 1 is a perspective environmental view of one mode of a Removable Maintenance Port disclosed herein, illustrating said system connected to an in-ground sewer line.
Figure 2:
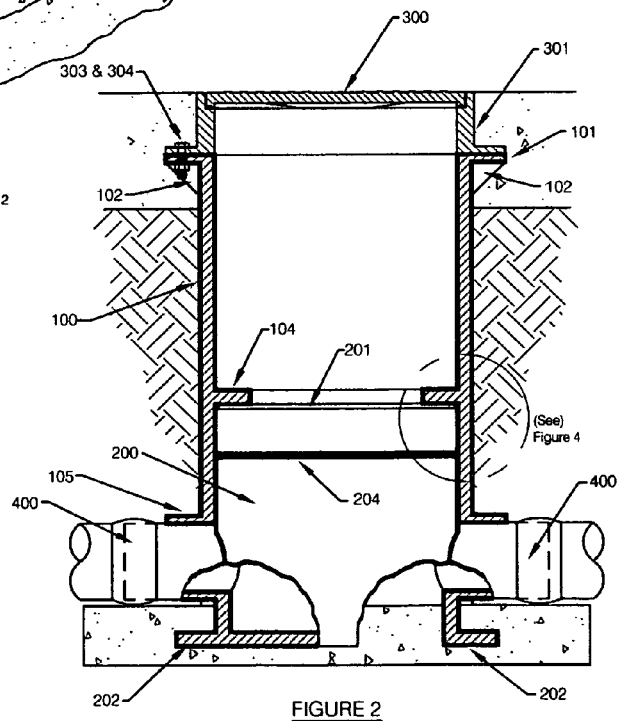
FIG. 2 is a cross-sectional environmental view of a system, disclosed herein, taken generally along line 2-2 of FIG. 1.
Figure 4:
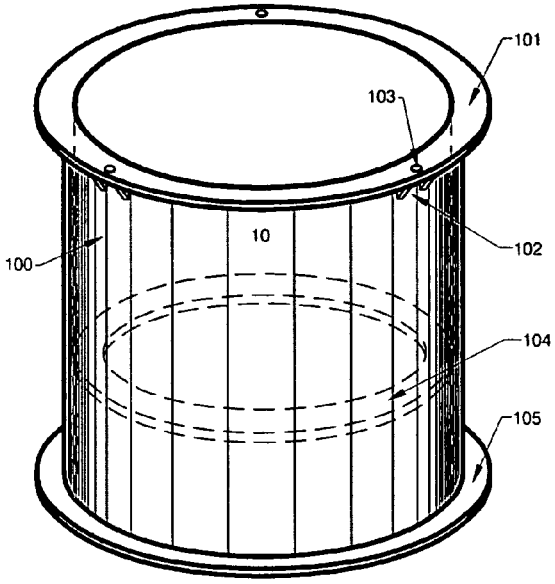
FIG. 4 is an enlarged, partial, cross-sectional view of an internal lower flange of a top unit of a system disclosed herein, at rest on a beveled top of a base unit of said system, with any gap between the inner diameter of the top unit and the outer diameter of the base unit sealed, as shown at circle 4-4 in FIG. 2.
Figure 4:
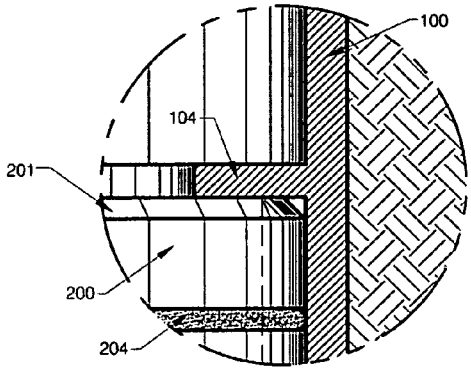
Figure 3:
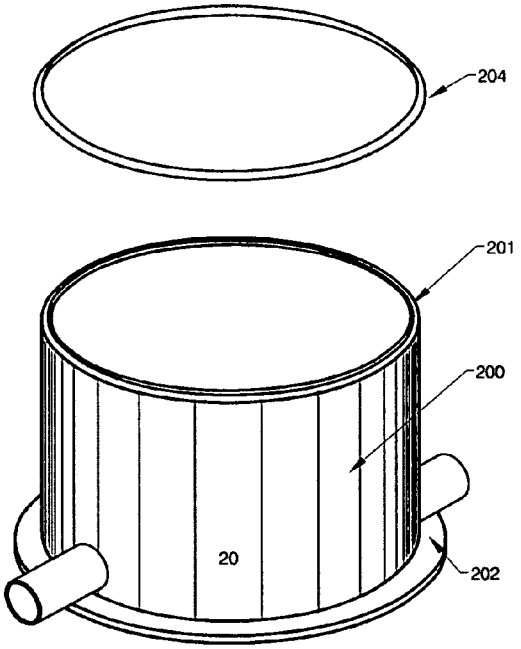
FIG. 3 is an exploded perspective view of a system disclosed herein.
Figure 5:
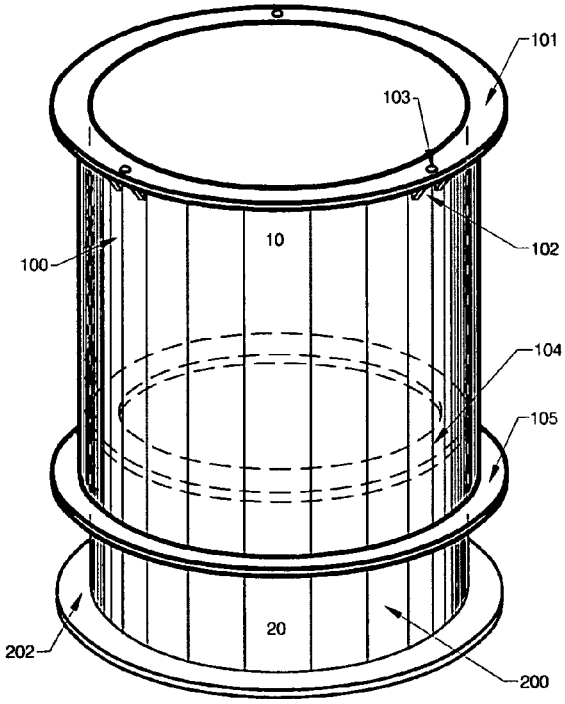
FIG. 5 is a perspective view of a top unit of a system disclosed herein, in solid lines, including a lower internal flange shown by dashed lines; and further showing an alternative mode of a top unit with dashed lines added at the bottom, which would extend over a base unit.
Figure 6:
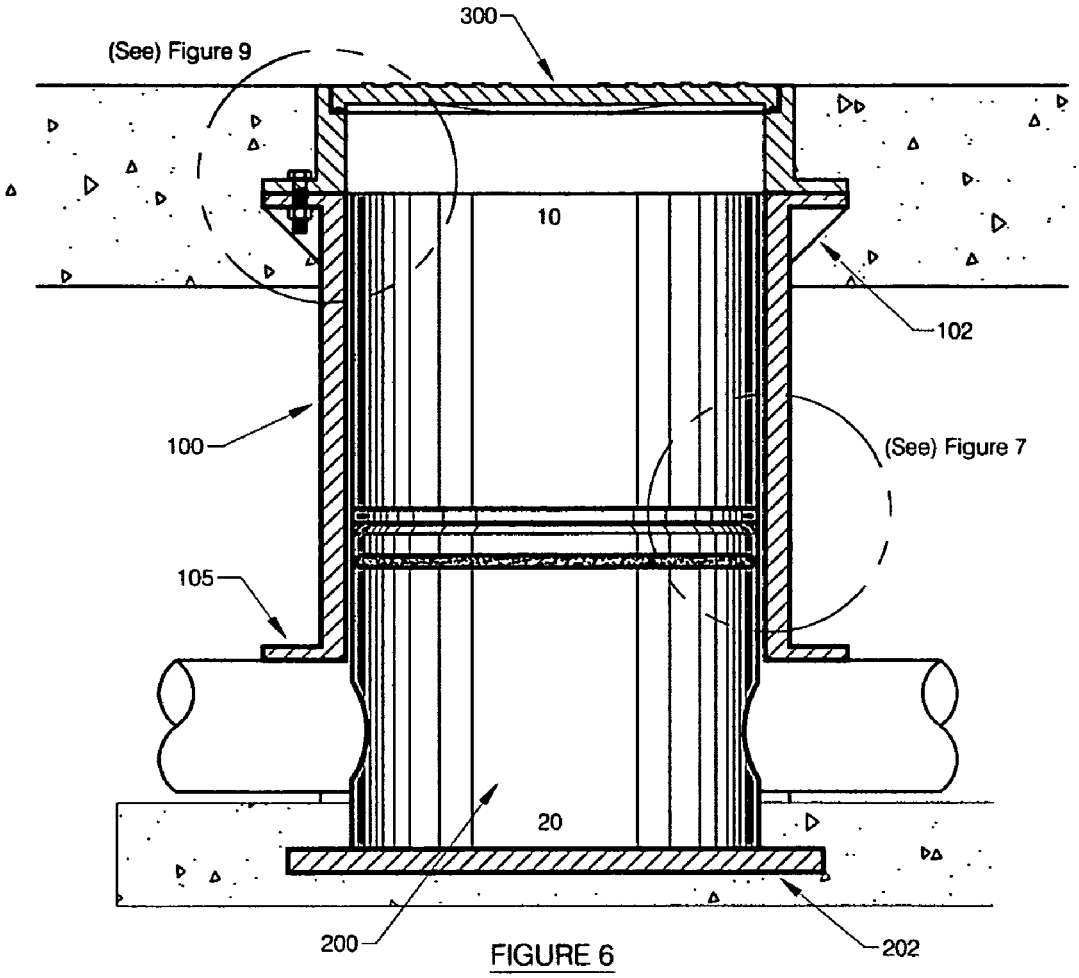
FIG. 6 is a cross-sectional view of a system disclosed herein, showing an external top flange of a top unit in two alternative embodiments, and further showing the top unit without a lower internal flange; and a base unit with a closed bottom, with an external flange, enclosed in a concrete pad.
Figure 7:
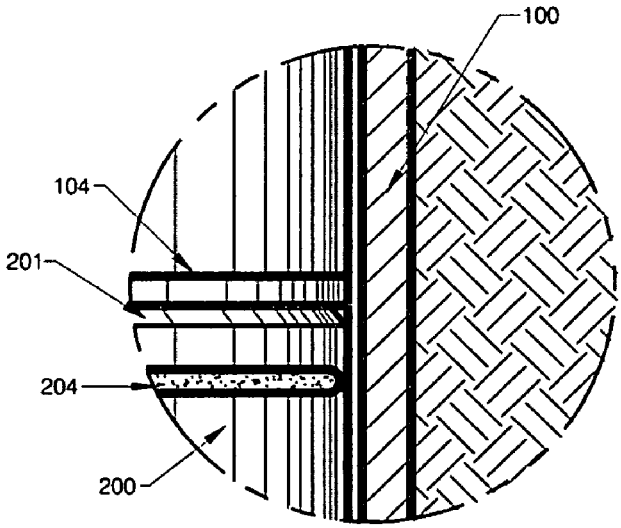
FIG. 7 is an enlarged, partial, cross-sectional view of a base unit with a flat top, covered by a top unit with no internal flange, with a seal between any gap between the top unit and base unit, as shown at circle 7-7 in FIG. 6.
Figure 8:
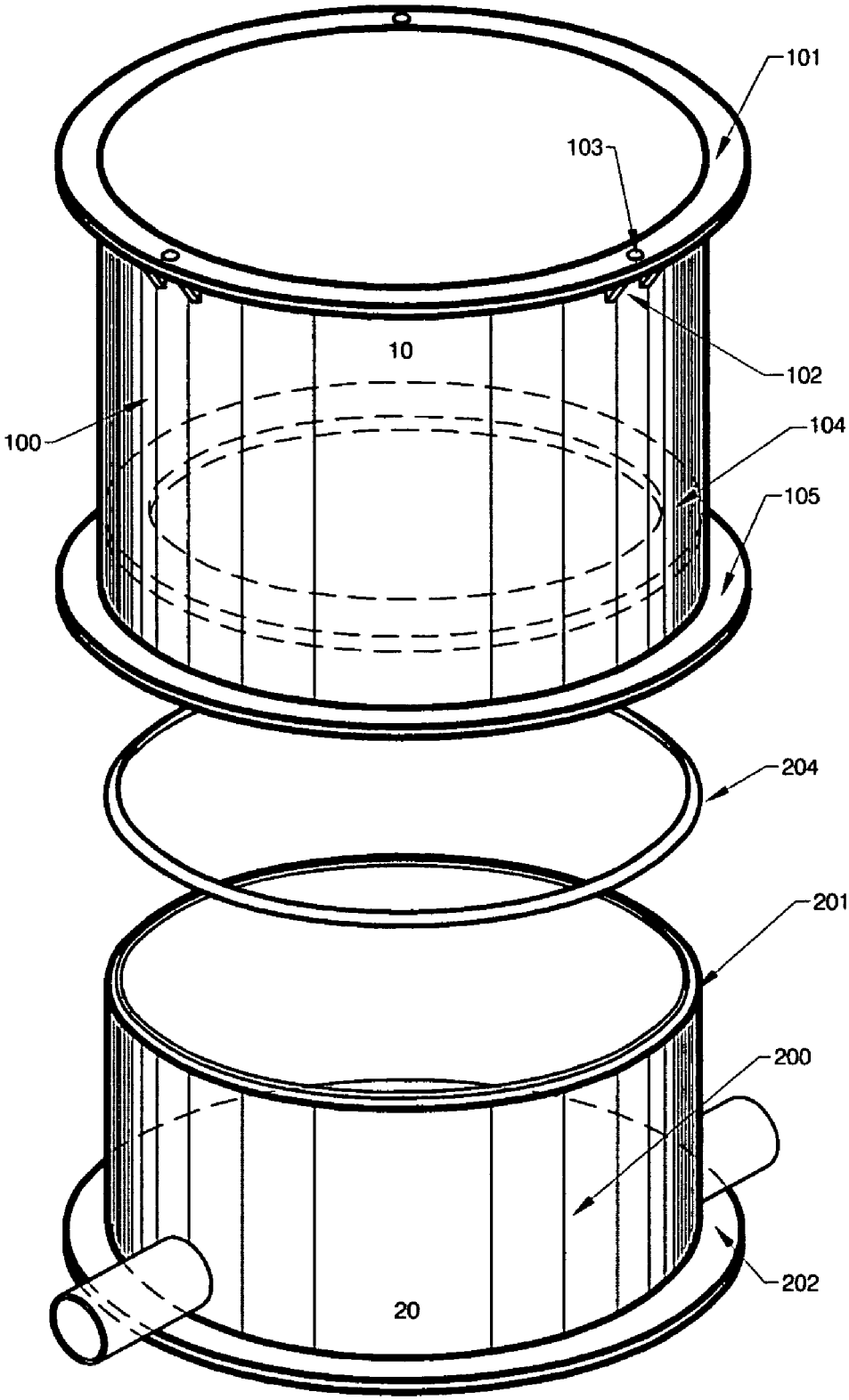
FIG. 8 is an exploded perspective view of a Removable Maintenance Port disclosed herein.
Figure 9:
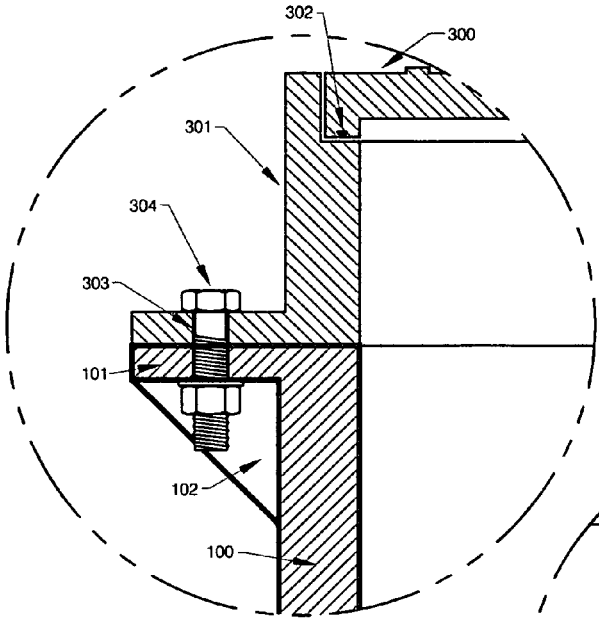
FIG. 9 is an enlarged, partial cross-sectional view of a top external flange of the top unit of the system, with a support for the external flange, and attached to a cover as shown at circle 9-9 in FIG. 6.
Figure 10:
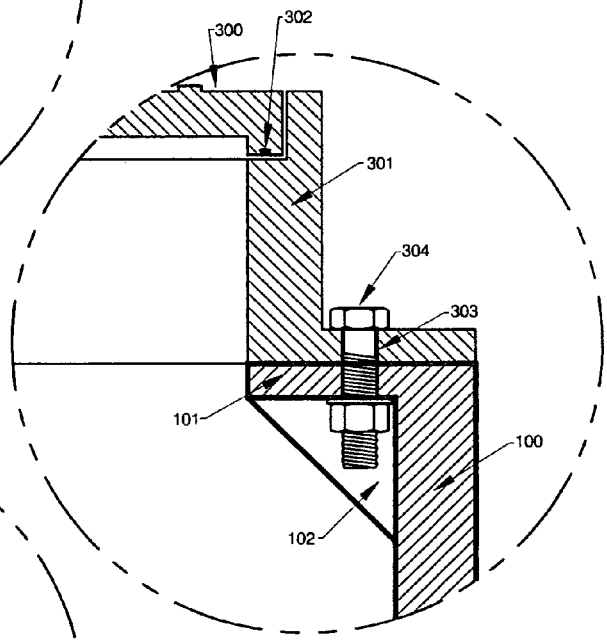
FIG. 10 is an enlarged, partial cross-sectional view of a top internal flange of a top unit of the system, with a support for the internal flange, and attached to a cover as shown at circle 9-9 in FIG. 6.
Figure 11:
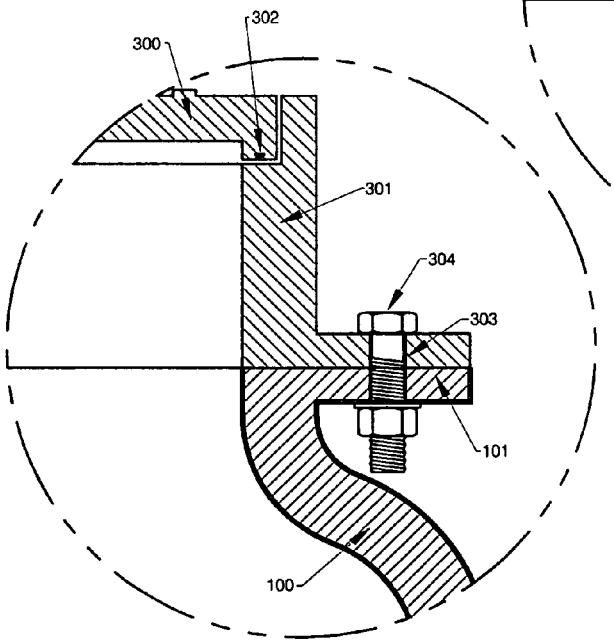
FIG. 11 is an enlarged, partial cross-sectional view of a top external flange of the top unit of the system, without a support for the external flange, and attached to a cover as shown at circle 9-9 in FIG. 6.
Figure 12:
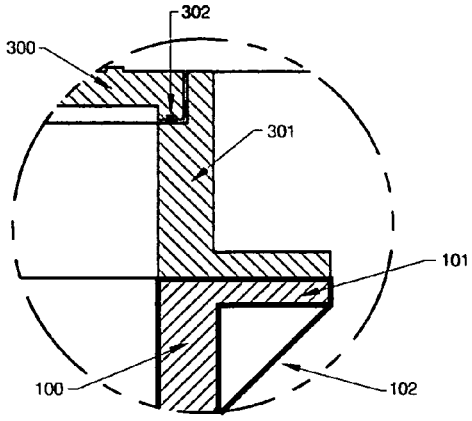
FIG. 12 is an enlarged, partial cross-sectional view of an alternative mode of the top external flange of the top unit of the system, without a support for the external flange, and attached to a cover as shown at circle 9-9 in FIG. 6.
Figure 13:
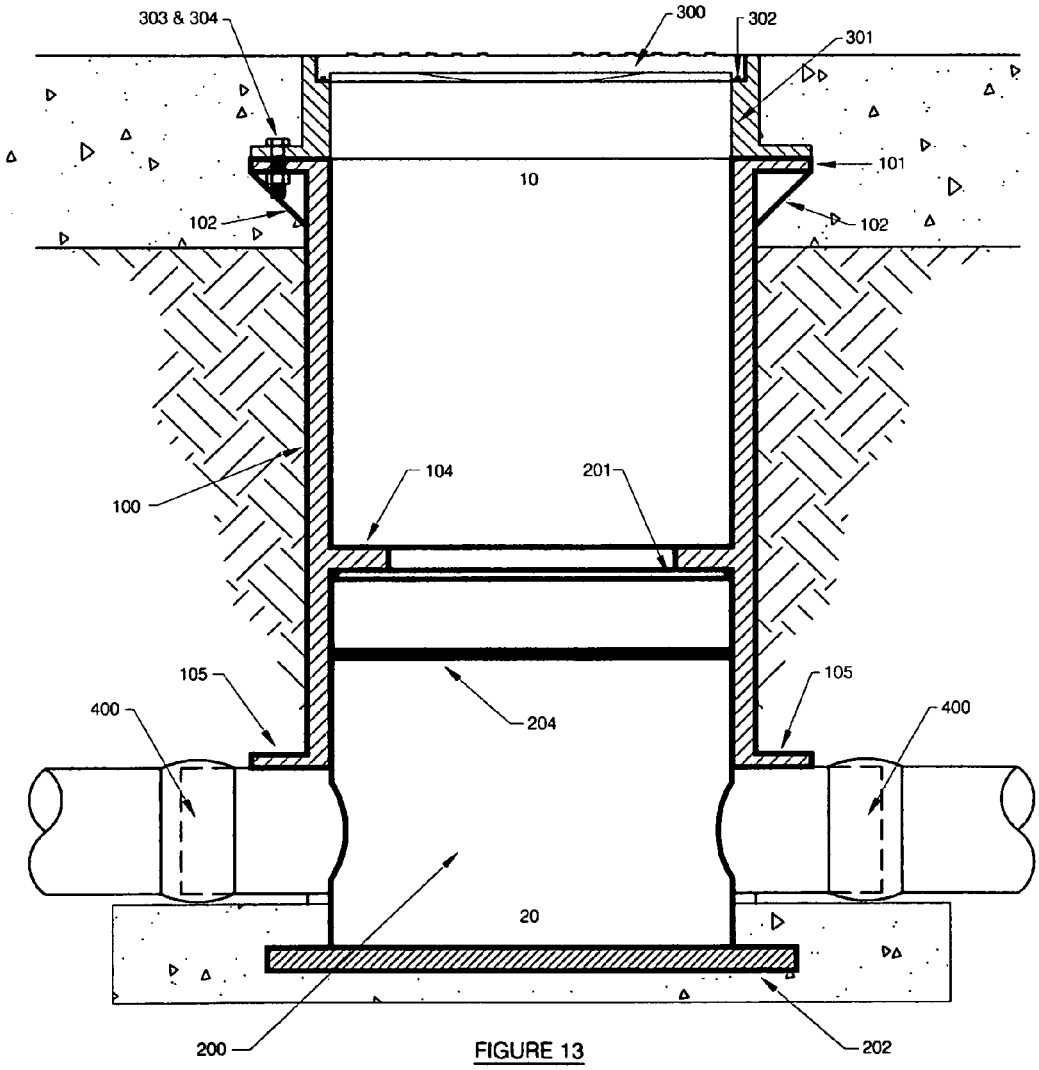
FIG. 13 is a cross-sectional environmental view of a Removable Maintenance Port disclosed herein.
Figure 14:
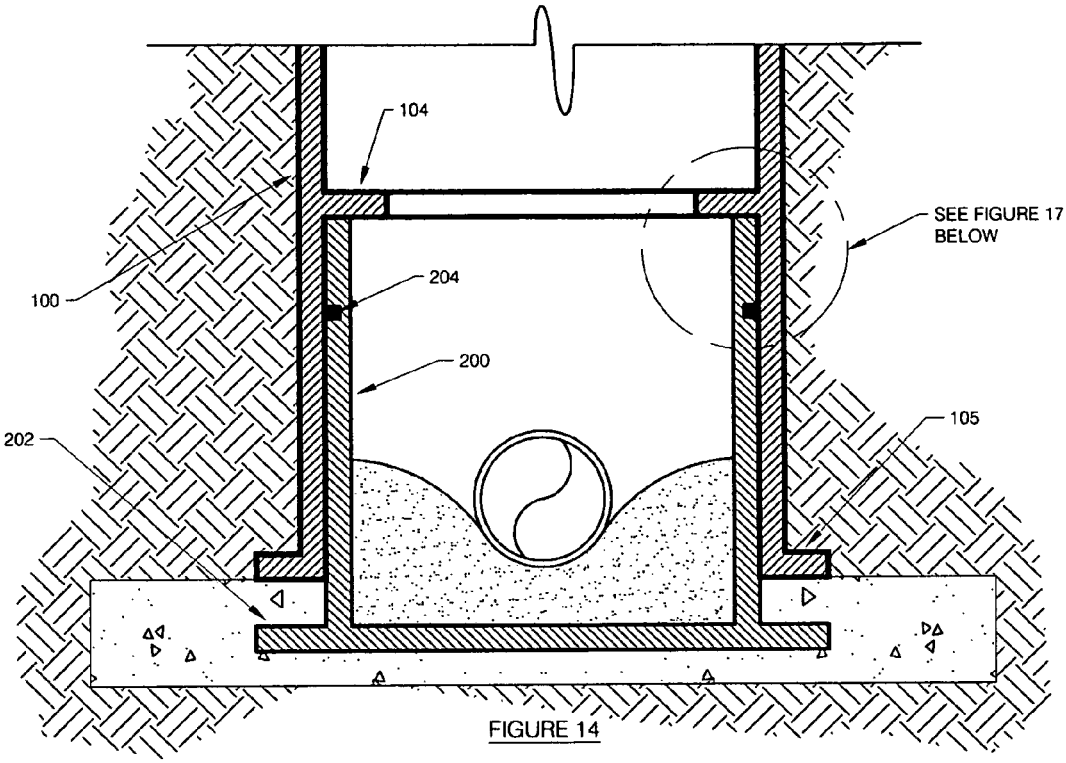
FIG. 14 is a partial cross-sectional environmental view of the system, showing an optional invert and bench area to direct fluid flow. This figure is taken along line 14-14 of FIG. 13.
Figure 15:
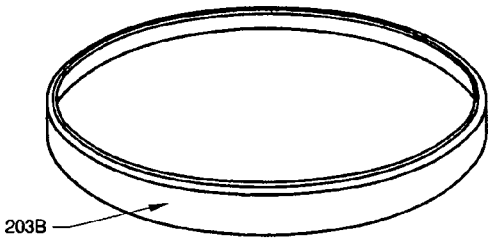
FIG. 15 is a perspective view of a spacer unit.
Figure 17:
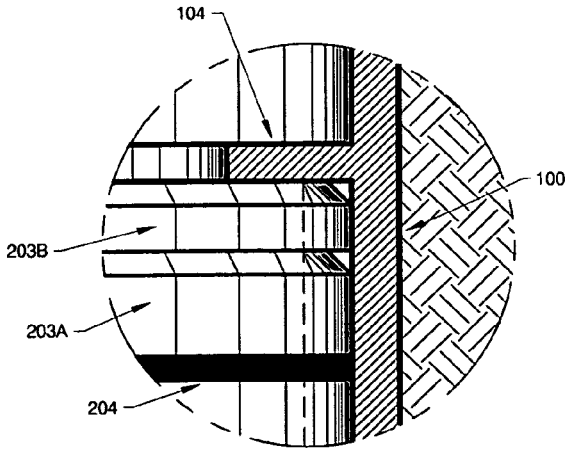
FIG. 17 is an enlarged, partial cross-sectional view of a Removable Maintenance Port, with a spacer as shown in FIG. 15.
Figure 16:
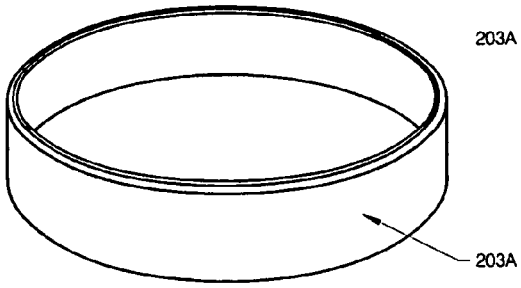
FIG. 16 is a perspective view of an alternative spacer unit.
Figure 18:
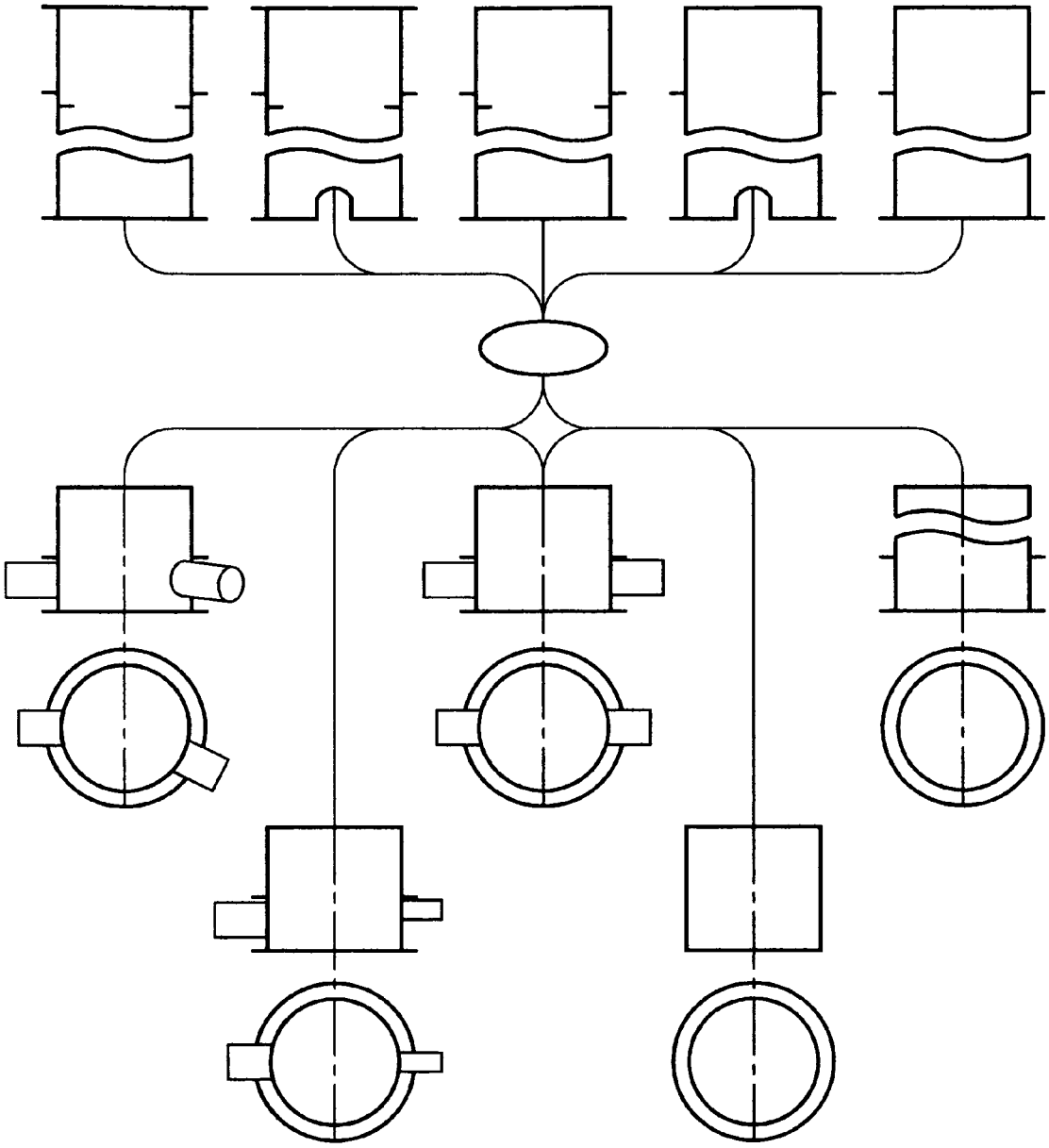
FIG. 18 is an exploded cross-sectional schematic showing various embodiments of a Removable Maintenance Port disclosed herein.

We claim:

1. A removably insertable apparatus for accessing underground pipes comprising:

an annular, hollow top unit made of a corrosion resistant load-bearing composite material, the interior diameter of which exceeds the exterior diameter of an annular, hollow base unit;

said base unit made of a corrosion resistant load-bearing composite material, the exterior diameter of which is less than the interior diameter of said top unit;

said base unit substantially permanently embedded into a surface below the underground pipes;

said base unit having a similar geometry to said top unit;

said top unit disposed so that said top unit fits over said base unit; and a means for sealing the space between the exterior of said base unit and the interior of said top unit, whereby the apparatus provides access to the underground pipes.

2. An apparatus according to claim 1, wherein the top unit has an exterior top flange.

3. An apparatus according to claim 2, wherein the top unit has an internal lower flange wherein the diameter of said internal flange is less than the diameter of the base unit upon which said top unit will rest.

4. An apparatus according to claim 2, wherein the external top flange of the top unit further comprises an external support for said top flange.

5. An apparatus according to claim 1, wherein the top unit has an internal lower flange whereby the diameter of said internal flange is less than the diameter of the base unit upon which said top unit will rest.

6. An apparatus according to claim 1, wherein the base unit further comprises a bottom external flange.

7. An apparatus according to claim 6, wherein the base unit further comprises stubout holes with means for connecting the underground pipes through said stubout holes.

8. An apparatus according to claim 7, wherein the means for connecting the underground pipes comprises commercially available T-type fittings with a means for sealing the T-type fittings to the base unit.

9. An apparatus according to claim 1, wherein the base unit further comprises stubout holes with means for connecting the underground pipes through said holes.

10. An apparatus according to claim 1, wherein the top unit further comprises an internal flange at the top of said top unit.

11. An apparatus according to claim 1, wherein said corrosion resistant load-bearing material is selected from the group consisting of: fiberglass reinforced unsaturated polyester resin, polyethylene, fiberglass, and preformed plastic.

12. An apparatus according to claim 1, wherein the means for sealing the space between the exterior of the base unit and the interior of the top unit is a gasket-like device.

13. An apparatus according to claim 1, wherein the base unit has a non-corrosive composite material which encloses an invert and bench area, disposed so that said invert and bench are at least 4 in. above the incoming pipelines.

14. A removably insertable apparatus for accessing underground pipes comprising:

an annular, hollow top unit made of a corrosion resistant load-bearing composite material, the interior diameter of which exceeds the exterior diameter of an annular, hollow base unit, wherein said top unit has an exterior top flange, and further wherein said top unit has an internal lower flange wherein the diameter of said internal flange is less than the diameter of the base unit upon which said top unit will rest, and further wherein said top unit has pre-formed stubout holes that permit said top unit to cover substantially the entire part of said base unit that contains connections to any underground pipes;

said base unit made of a corrosion resistant load-bearing composite material, exterior diameter of which is less than the interior diameter of said top unit;

said base unit substantially permanently embedded into a surface below the underground pipes;

said base unit having a similar geometry to said top unit;

said top unit disposed so that said top unit fits over said base unit; and a means for sealing the space between the exterior of said base unit and the interior of said top unit, whereby the apparatus provides access to the underground pipes.

15. An apparatus according to claim 14, wherein the top unit has a lower external flange at the bottom of the top unit.

16. A removably insertable apparatus for accessing underground pipes comprising:

an annular, hollow top unit made of a corrosion resistant load-bearing composite material, the interior diameter of which exceeds the exterior diameter of an annular, hollow base unit, and further wherein said top unit has pre-formed stubout holes that permit said top unit to cover substantially the entire part of said base unit that contains connections to any underground pipes;

said base unit made of a corrosion resistant load-bearing composite material, exterior diameter of which is less than the interior diameter of said top unit;

said base unit substantially permanently embedded into a surface below the underground pipes;

said base unit having a similar geometry to said top unit;

said top unit disposed so that said top unit fits over said base unit; and a means for sealing the space between the exterior of said base unit and the interior of said top unit, whereby the apparatus provides access to the underground pipes.

17. A removably insertable apparatus for accessing underground pipes comprising:

an annular, hollow top unit made of a corrosion resistant load-bearing composite material, the interior diameter of which exceeds the exterior diameter of an annular, hollow base unit, wherein said top unit has an exterior top flange, and further wherein said top unit has pre-formed stubout holes that permit said top unit to cover substantially the entire part of said base unit that contains connections to any underground pipes;

said base unit made of a corrosion resistant load-bearing composite material, exterior diameter of which is less than the interior diameter of said top unit;

said base unit substantially permanently embedded into a surface below the underground pipes;

said base unit having a similar geometry to said top unit;

said top unit disposed so that said top unit fits over said base unit; and a means for sealing the space between the exterior of said base unit and the interior of said top unit, whereby the apparatus provides access to the underground pipes.

18. A removably insertable apparatus for accessing underground pipes comprising:

an annular, hollow top unit made of a corrosion resistant load-bearing composite material, the interior diameter of which exceeds the exterior diameter of an annular, hollow base unit, wherein said top unit has an exterior top flange, and further wherein said top unit is pre-formed so that it is narrower at the top, immediately prior the external flange, such that said external flange does not require any external support;

said base unit made of a corrosion resistant load-bearing composite material, exterior diameter of which is less than the interior diameter of said top unit;

said base unit substantially permanently embedded into a surface below the underground pipes;

said base unit having a similar geometry to said top unit;

said top unit disposed so that said top unit fits over said base unit; and a means for sealing the space between the exterior of said base unit and the interior of said top unit, whereby the apparatus provides access to the underground pipes.

19. A removably insertable apparatus for accessing underground pipes comprising:

an annular, hollow top unit made of a corrosion resistant load-bearing composite material, the interior diameter of which exceeds the exterior diameter of an annular, hollow base unit, wherein said top unit has an exterior top flange, and further wherein the external flange further comprises pre-existing holes;

said base unit made of a corrosion resistant load-bearing composite material, exterior diameter of which is less than the interior diameter of said top unit;

said base unit substantially permanently embedded into a surface below the underground pipes;

said base unit having a similar geometry to said top unit;

said top unit disposed so that said top unit fits over said base unit; and a means for sealing the space between the exterior of said base unit and the interior of said top unit, whereby the apparatus provides access to the underground pipes.

20. A removably insertable apparatus for accessing underground pipes comprising:

an annular, hollow top unit made of a corrosion resistant load-bearing composite material, the interior diameter of which exceeds the exterior diameter of an annular, hollow base unit;

said base unit made of a corrosion resistant load-bearing composite material, exterior diameter of which is less than the interior diameter of said top unit;

said base unit substantially permanently embedded into a surface below the underground pipes;

said base unit having a similar geometry to said top unit;

said top unit disposed so that said top unit fits over said base unit;

a means for sealing the space between the exterior of said base unit and the interior of said top unit, whereby the apparatus provides access to the underground pipes; and further comprising a spacer unit made of a corrosion resistant load-bearing composite material, such that the interior diameter of said spacer unit exceeds the exterior diameter of said base unit, and such that the exterior diameter of said spacer unit is smaller than the interior diameter of said top unit.

21. An apparatus according to claim 20, wherein the spacer unit comprises a flat top surface.

22. An apparatus according to claim 20, wherein the spacer unit comprises a beveled top surface.

23. A method for rehabilitating manhole structures, comprising the steps of:

a. removing the old underground pipes, connectors, and T-type inserts from inside the bottom of the manhole structure;

b. leaving the remaining elements of said manhole structure in place and otherwise intact;

c. preparing the bottom of said manhole structure by clearing the debris out of said manhole structure down to the bottom of said manhole structure;

d. inserting the base unit into said manhole structure;

e. embedding said base unit into the bottom of said manhole structure by a substantially permanent means for securing said base unit;

f. connecting said underground pipes already in place to said base unit;

g. sealing the connections between said underground pipes and said base unit;

h. backfilling around said base unit with an inert material;

i. mechanically tamping said inert material around said base unit;

j. adding additional inert material to bring the top fill line of said inert material to a location slightly above the lowest exposed part of the exterior of said base unit;

k. placing a means for sealing the top unit with said base unit, so that said means for sealing is disposed below the top of the highest elevation of said base unit;

l. disposing said top unit over the top of said base unit wherein the inner diameter of said top unit is greater than the outer diameter of said base unit;

m. replacing the pre-existing means for securing said manhole structure;

n. re-surfacing the ground access to said manhole structure so that the highest elevation of said means for securing said manhole structure is disposed below the surface of the ground access;

o. replacing the means previously used for sealing said manhole structure over said means for securing the top of said manhole structure; and p. affixing said means for sealing said manhole structure whereby said means is substantially permanent.

* * * * *